US011209010B2

(12) United States Patent
Stoyanov et al.

(10) Patent No.: US 11,209,010 B2
(45) Date of Patent: Dec. 28, 2021

(54) MULTILAYER ABRADABLE COATING

(71) Applicant: United Technologies Corporation, Farmington, CT (US)

(72) Inventors: Pantcho P. Stoyanov, West Hartford, CT (US); Agnieszka M. Wusatowska-Sarnek, Mansfield Ctr., CT (US); Thomas D. Kasprow, Glastonbury, CT (US); David Ulrich Furrer, Marlborough, CT (US); Sergei F. Burlatsky, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 234 days.

(21) Appl. No.: 15/430,783

(22) Filed: Feb. 13, 2017

(65) Prior Publication Data

US 2018/0231014 A1 Aug. 16, 2018

(51) Int. Cl.

| | |
|---|---|
| ***C23C 28/00*** | (2006.01) |
| ***F04D 29/16*** | (2006.01) |
| ***C23C 28/02*** | (2006.01) |
| ***F01D 5/28*** | (2006.01) |
| ***F01D 11/12*** | (2006.01) |

(Continued)

(52) U.S. Cl.

CPC ..... *F04D 29/164* (2013.01); *C23C 4/12* (2013.01); *C23C 24/04* (2013.01); *C23C 28/022* (2013.01); *C23C 28/027* (2013.01); *C23C 28/324* (2013.01); *C23C 28/3455* (2013.01); *C23C 28/42* (2013.01); *F01D 5/288* (2013.01); *F01D 11/122* (2013.01); *F04D 29/526* (2013.01); *F05D 2230/31* (2013.01)

(58) Field of Classification Search

CPC ..... C23C 4/12; C23C 24/04; C23C 28/027; C23C 28/324; C23C 28/022; C23C 28/42; C23C 28/3455; F04D 29/164; F04D 29/526; F01D 11/122; F01D 5/288; F05D 2230/31

See application file for complete search history.

(56) References Cited

U.S. PATENT DOCUMENTS 4,422,648 A * 12/1983 Eaton ..... F01D 11/12 277/415
5,024,884 A * 6/1991 Otfinoski ..... B22F 3/26 415/174.4

(Continued)

FOREIGN PATENT DOCUMENTS

EP 0187612 A2 7/1986
EP 2281913 A1 2/2011

(Continued)

OTHER PUBLICATIONS

Aouadi et al., "Adaptive VN/Ag nanocomposite coatings with lubricious behavior from 25 to 1000° C", Acta materials Inc., published by Elsevier Ltd., (2010) pp. 5236-5331.

(Continued)

*Primary Examiner* — David Hamaoui

(74) *Attorney, Agent, or Firm* — Bachman and LaPointe PC; George Coury

(57) ABSTRACT

A multilayer abradable coating includes at least one first abradable layer; and at least one second abradable layer, wherein the first abradable layer and the second abradable layer have different properties related to erosion resistance.

12 Claims, 3 Drawing Sheets

(51) Int. Cl.

| | |
|---|---|
| ***C23C 4/12*** | (2016.01) |
| ***C23C 24/04*** | (2006.01) |
| ***F04D 29/52*** | (2006.01) |

(56) References Cited

U.S. PATENT DOCUMENTS

| | | | | |
|---|---|---|---|---|
| 5,702,829 | A * | 12/1997 | Paidassi | C23C 14/0021 428/610 |
| 5,705,231 | A * | 1/1998 | Nissley | C23C 4/02 427/453 |
| 6,352,264 | B1 * | 3/2002 | Dalzell, Jr. | F01D 11/122 277/415 |
| 8,124,252 | B2 * | 2/2012 | Cybulsky | C04B 41/009 428/304.4 |
| 8,142,252 | B1 | 2/2012 | Cybulsky et al. | |
| 8,470,460 | B2 * | 6/2013 | Lee | C04B 41/009 416/241 B |
| 8,852,720 | B2 * | 10/2014 | Bolcavage | F01D 5/288 428/167 |
| 9,447,861 | B2 | 9/2016 | Eitzinger et al. | |
| 2003/0054196 | A1 * | 3/2003 | Lau | C23C 4/02 428/655 |
| 2005/0003172 | A1 * | 1/2005 | Wheeler | F01D 11/122 428/210 |
| 2008/0107920 | A1 * | 5/2008 | Rowe | F01D 5/288 428/701 |
| 2014/0199163 | A1 * | 7/2014 | Lee | C23C 28/04 415/174.4 |
| 2017/0306783 | A1 * | 10/2017 | Grande | F01D 11/122 |

FOREIGN PATENT DOCUMENTS

| | | | |
|---|---|---|---|
| EP | 2372104 | A2 | 10/2011 |
| EP | 2574727 | A1 | 4/2013 |
| EP | 2 452 226 | B1 | 1/2016 |
| EP | 3239475 | A1 | 11/2017 |
| GB | 2121884 | A | 1/1984 |
| WO | 2008054340 | A2 | 5/2008 |
| WO | 2012122373 | A1 | 9/2012 |

OTHER PUBLICATIONS

European search report for patent application No. 18156006.1-1108 dated Jun. 29, 2018.

* cited by examiner

MULTILAYER ABRADABLE COATING

BACKGROUND

The present disclosure is directed to abradable coatings for turbofan engine components such as compressor components.

Certain components of gas turbines and compressors call for as little clearance as possible between them in order to enhance a seal between the components and limit leakage of gas between the components and the resulting loss in efficiency. These components can be designed to occasionally rub or impact each other, and an abradable surface or coating can be applied or disposed on one or both of the components.

It is desired that abradable coatings be abradable when rubbed by an adjacent moving component, which for example can have an abrasive surface designed to abrade the abradable coating. It is still also desired, however, that such abradable surface or coating be erosion resistant.

Depending upon the operating conditions of the gas turbine or compressor, erosive particles can impact the coating from various angles.

SUMMARY

According to the disclosure, a coating is provided which is abradable and also retains good erosion resistance in various different conditions of erosion.

In one aspect, the disclosure relates to a multilayer abradable coating which comprises at least one first abradable layer; and at least one second abradable layer, wherein the first abradable layer and the second abradable layer have different properties related to erosion resistance.

In another aspect of the disclosure, the first abradable layer has higher erosion resistance than the second abradable layer against impacts at a high low angle of incidence, and the second abradable layer has higher erosion resistance than the first abradable layer against impacts at a low high angle of incidence.

In another aspect of the disclosure, the first abradable layer has a higher porosity fraction than the second abradable layer.

In another aspect of the disclosure, the first abradable layer has a porosity fraction of between about 0.15 and about 0.5, and the second abradable layer has a porosity fraction of between about 0.02 and about 0.1.

In another aspect of the disclosure, the first abradable layer comprises a MCrAlY alloy where M is Ni, Co or NiCo, and the second abradable layer comprises zirconia, magnesia, alumina or combinations thereof.

In another aspect of the disclosure, at least one of the first abradable layer and the second abradable layer further comprises a solid lubricant.

In another aspect of the disclosure, the solid lubricant is selected from the group consisting of graphene, graphite, graphite intercalation compounds, highly oriented pyrolytic graphite, molybdenum disulfide, clay, black phosphorous, hexagonal boron nitride, tungsten diselenide, rhenium disulfide, and combinations thereof.

In another aspect of the disclosure, an abradable coated part of a compressor is provided, comprising a substrate; and a multilayer abradable coating on the substrate, the coating comprising at least one first abradable layer; and at least one second abradable layer, wherein the first abradable layer and the second abradable layer have different properties related to erosion resistance.

In another aspect of the disclosure, an abradable seal between two components of a compressor is provided, which comprises a coated part as disclosed herein and an abrasive part moveable relative to the coated part and configured to rub and abrade the coated part.

In another aspect of the disclosure, a method for applying an abradable coating to a substrate is provided, which comprises the steps of: applying a first abradable layer to the substrate; and applying a second abradable layer over the first abradable layer, wherein the first abradable layer and the second abradable layer have different properties related to erosion resistance.

BRIEF DESCRIPTION OF THE DRAWINGS

A detailed disclosure of exemplary embodiments follows, with reference to the attached drawings, wherein.

DETAILED DESCRIPTION

The disclosure relates to an abradable coating for use in providing desired abradability along with resistance to erosion, with a coating that is also more economical than known coatings.

Figure 1:
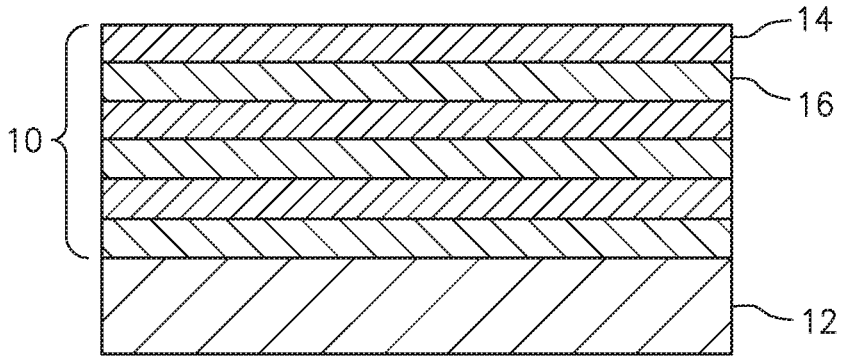
FIG. 1 illustrates a multilayer abradable coating.

FIG. 1 shows a coating 10 on a substrate 12, wherein the coating is a multiple layer abradable coating, with individual layers identified at 14, 16. In the exemplary embodiment, a plurality of each layer 14, 16 are provided, in alternating fashion as shown, so that substrate 12 is coated by alternating abradable layers 14, 16.

Abradable coatings are commonly exposed to fluctuation in contact conditions which can lead to severe erosive wear and, consequently, an overall reduction in performance. Current coatings are made with various filler materials to provide acceptable properties, but these coatings lead to excessive cost per compressor stage in an engine. The disclosed abradable coating produces desirable resistance to erosion even when subjected to fluctuating contact conditions, and does so at a reasonable cost, which can significantly reduce overhaul costs.

Figure 2:
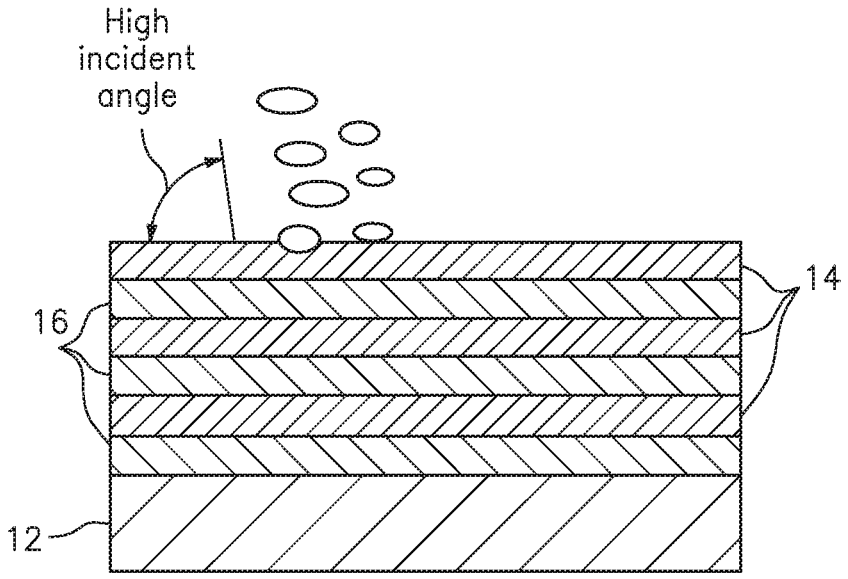
FIG. 2 illustrates impact of erosive particles with a multilayer abradable coating from a high angle of incidence.
Figure 3:
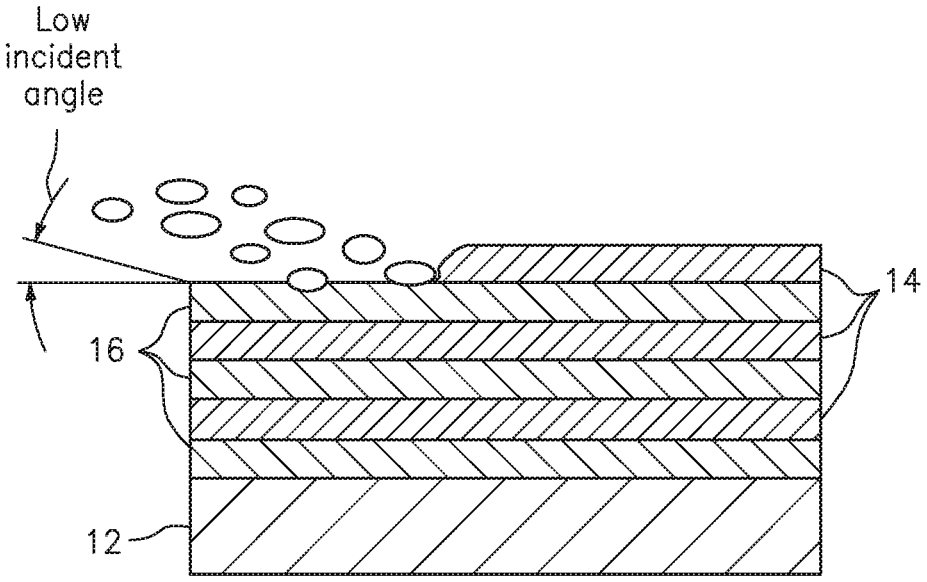
FIG. 3 illustrates impact of erosive particles with a multilayer abradable coating from a low angle of incidence.

In an exemplary embodiment, layers 14, 16 have different properties related to erosion resistance. One exemplary embodiment of the different properties is different properties with respect to resistance to erosion from particulate impact at different angles of impact or angles of incidence to the abradable coating. In a further exemplary embodiment, layers 14 are resistant to erosion when impacted by particles at a high angle of incidence, while layers 16 are resistant to erosion when impacted by particles at a low angle of incidence. Examples of these conditions are shown in FIGS. 2 and 3, respectively. In this regard, a layer is considered to be resistant to erosion when it has an erosion resistance of less than or equal to 0.05 $cm^3/g$, for example as measured by ASTM G76, using a particulate erosion tester at ambient or elevated temperatures, wherein the measure is taken by dividing the volume of loss of material ($cm^3$) by the total mass of particles (g). As it relates to the present disclosure, in an exemplary embodiment, layers 14 can have an erosion resistance against particles impacting from a high angle of incidence of less than or equal to 0.05 $cm^3/g$, and layers 16 can have an erosion resistance against particles impacting from a low angle of incidence of less than or equal to 0.05 $cm^3/g$. In each case, the erosion resistance to impacts from the opposite angle, i.e., low angle of incidence with a layer 14 or high angle of incidence with a layer 16, would be higher than the desired 0.05 $cm^3/g$. However, erosion of one layer from particles at such an angle would then expose a layer with the desired erosion resistance.

When a multilayer coating according to the disclosure encounters fluctuating erosion conditions, for example a change in angle of incidence from the condition of FIG. 2 to the condition of FIG. 3, the now-low angle of incidence particle contact will erode one layer 14 as shown in FIG. 3, but will then encounter a layer 16 which is resistant to erosion at low angles of incidence. In this way, fluctuation in erosion conditions results in erosion of one layer but then preservation of the remaining multilayer coating such that the coating has an extended lifetime. Further, when preparing such a multilayer coating, the materials to be used to provide alternating resistance to erosion at a high angle of incidence in one layer, and resistance to erosion at a low angle of incidence in the next layer, can be materials which are more economical than those used in known coating systems.

In an exemplary embodiment, the difference in properties between layers 14, 16 is a difference in porosity fraction. In one aspect of the disclosure, layer(s) 16, having good resistance against erosion from particulate impact at low angles of incidence, can be provided having a porosity fraction of between about 0.02 and 0., while layer(s) 14, having good resistance against erosion from particulate impact at high angles of incidence, can be provided with a porosity fraction of between about 0.15 and about 0.5. This difference in porosity fraction can be provided in layers of the same material by manipulating the coating process and/or material to produce a higher porosity and/or a lower density in one layer, and a lower porosity and/or higher density in the next. For example, a layer can be provided with porosity by including an organic binder in the coating material and then burning off or otherwise removing the binder to leave the open space or porosity in the layer. Some layers may be produced with substantially no porosity, which is considered to be a layer having a porosity fraction of about 0.02 within the low end of the range discussed above.

In an alternative exemplary embodiment, the different property of the layers 14, 16 can be produced by making layers 14, 16 from different materials. These different materials can themselves have different properties, or they can be used in layers having different porosity fraction as discussed above, or both.

Figure 4:
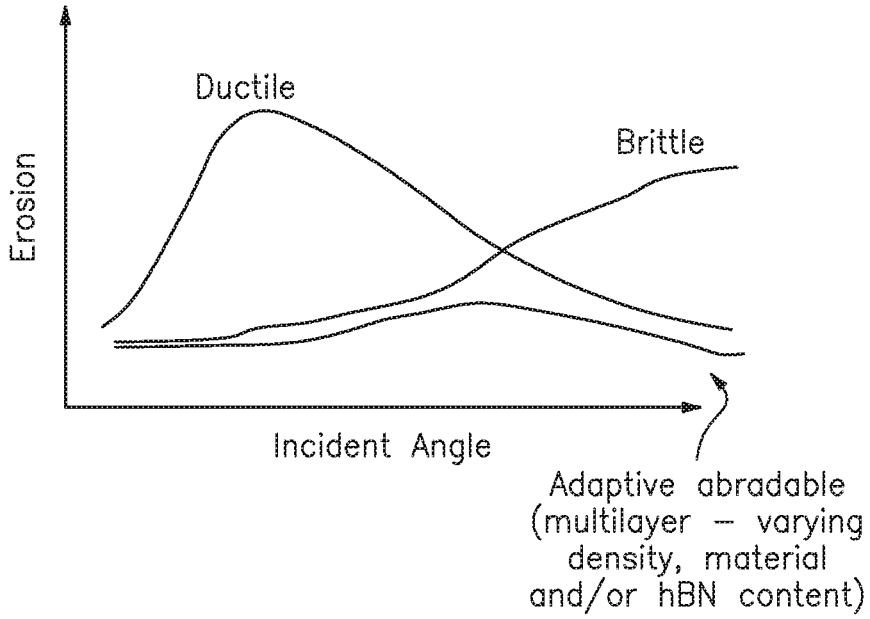
FIG. 4 illustrates a relationship between incident angle and erosion for ductile and brittle layers of a multilayer abradable coating.

In order to provide the desired alternating layers having different erosion resistance, an abradable coating can be produced from alternating layers that are relatively ductile and relatively brittle. FIG. 4 shows a relationship between erosion rate and incident angle for such ductile and brittle materials. As illustrated, ductile material has a higher resistance to erosion (i.e. lower erosion rate) at higher incident angles, while brittle material has higher resistance to erosion at lower incident angles.

As set forth above, the relatively ductile and brittle layers can be formed according to one aspect of this disclosure by forming each layer having different porosity fraction.

Alternatively, or in addition, the materials for the layers can be different, for example with the relatively ductile layer being formed from MCrAlY alloy, wherein M can be Ni, Co and combinations thereof, and with the relatively brittle material being zirconia, magnesia, alumina or mixtures thereof. One particularly suitable material for the relatively brittle material is zirconia.

In addition, solid lubricants can be added to one or both pluralities of layers to produce and/or supplement the different properties of alternating layers with respect to erosion resistance and/or to improve the overall abradability of the resulting coating. These solid lubricants can include, for example, graphene, graphite, graphite intercalation compounds, highly oriented pyrolytic graphite, molybdenum disulfide, clay, black phosphorous, hexagonal boron nitride, tungsten diselenide, rhenium disulfide, and combinations thereof. In one exemplary embodiment, hexagonal boron nitride (hBN) can be included in some or all layers. For example, one layer having a thickness of between about 30 and about 100 μm can contain between about 0 and about 10% wt. hBN, while a following layer having roughly the same thickness can contain between about 30 and about 65% wt. hBN.

The alternating layers of the abradable coating as disclosed herein can be applied using any known technique, for example including thermal spraying, cold spraying and the like.

Abradable coating according to this disclosure can advantageously have a thickness for each layer of between about 30 and about 150 μm. In addition, the total thickness of the abradable coating, including all layers, can advantageously be less than or equal to 400 μm. The thicknesses of the layers and overall assembled coating can be tailored to meet the specific requirements of the application environment. For example, if there is more potential for high angle particle impact, layers resistant to this condition can be increased in thickness and/or in number, and vice versa.

In another exemplary embodiment, the brittle layer(s) can have high resistance against erosion due to particles which have a low angle of incidence with a surface of the abradable coating, which is considered to be an angle of between 0 and 30 degrees, as schematically illustrated in FIG. 2. Furthermore, the ductile layer(s) can have high resistance against erosion due to particles having a low angle of incidence with the surface of the abradable coating, which is considered to be an angle between about >0 and 30 degrees. In connection with measurement of erosion resistance for these layers, the procedures of ASTM G76 can be followed, with the angle of incidence being taken at 70 degrees to evaluate the layers having resistance due to particles impacting at a high angle of incidence, and with the angle of incidence being taken at 15 degrees to evaluate the layers having resistance due to particles impacting at a low angle of incidence. In each case, the layers should have a resistance to erosion at the relevant angle of incidence of less than about 0.05 $cm^3/g$ as determined by ASTM G76, modified as to the angle as discussed above.

It should be noted that there is an interface between layers of the system according to the disclosure. This interface can be a flat interface, or the interface can be a wavy, interlocked interface, which enhances layer-to-layer bond strength. Different characteristics of the interface can be created depending upon the process used to apply each layer, the composition and interaction between compositions of adjacent layers, or both. Further, depending upon the materials and processes used, multi-faceted interfaces can be created between layers, and these multi-faceted interfaces or layers can have changes of angle compared to rub and impact erosion. Multi-faceted layers, that is, an interface with changes of angle compared to rub and impact erosion, can allow for optimal rub and erosion at least at portions of the coating axial length. Therefore, such an interface can provide improvements in seal and erosion protection. A multi-faceted interface can produce these areas where optimal erosion protection is produced, while also providing areas where the interface has less optimal performance. However, overall system performance can be improved.

It should also be noted that the interface can also be produced as a graded layer, phasing out of the material of one layer and into the material of the next layer. This can be desirable if a more gradual transition between the properties of erosion resistance is desired. The thickness of the graded layer can be selected based also upon how gradual of a transition between properties is desired, and can for example be less than or equal to 10 μm.

It should still further be noted that although the different types of layers are referred to herein as first and second layers, this is for the purpose of distinguishing between them, and either layer can be the first and/or last layer applied, depending upon the expected conditions to which the coating is to be exposed.

In a further aspect of the disclosure, a bond coat can be applied to a substrate in advance of the multilayer coating disclosed herein, for example to enhance adhesion of the coating to the substrate. Suitable materials for the bond coat can be NiCoCrAlY or NiAl as non-limiting examples, or the like.

Figure 5:
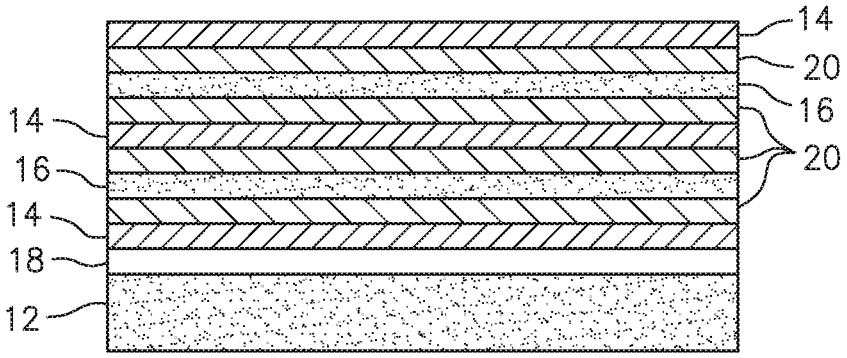
FIG. 5 illustrates a multilayer abradable coating including bond coat and graded layers.

Referring to FIG. 5, a multilayer coating is illustrated wherein a bond coat 18 is applied to the substrate, and wherein there is a graded layer 20 between layers 14, 16 of the multilayer coating. As set forth above, the graded layer is a transition layer from the material of one layer 14 to the material of the other layer 16, and these graded layers can have a thickness of less than or equal to about 10 μm.

Figure 6:
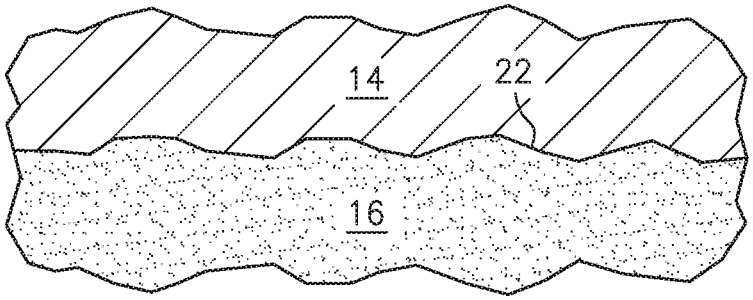
FIG. 6 illustrates a wavy interface between layers.

Referring to FIG. 6, an interface 22 between layers 14, 16 is illustrated and in this case can have a wavy shape as discussed above. Similarly, this interface could be multi-faceted, as such a configuration can provide desirable properties of enhanced erosion resistance.

Figure 7:
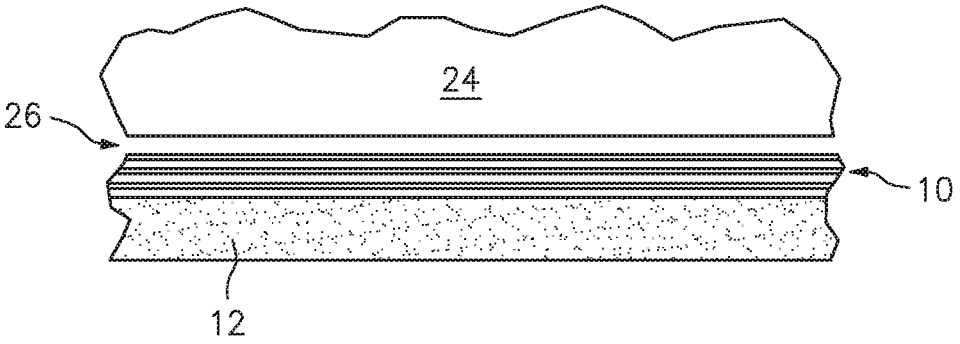
FIG. 7 schematically illustrates a seal between an abradable coated substrate and abrasive part which moves relative to the substrate.

As set forth above, the abradable coated part disclosed herein typically defines a seal with another component, for example a moving component of a compressor such as a fan blade. FIG. 7 shows substrate 12 with coating 10, and a component or fan blade 24 which can have an abrasive coating (not shown) and which is intended to abrade coating 10 during operation of these components 12, 24. A seal 26 between components 12, 24 is maintained for an extended useful lifetime of the components by a controlled abrasion during rub of component 24 against component 12 during such operation. As disclosed herein, desired abradability of coating 12 is maintained, even when coating 12 is exposed to potentially varying erosion factors due to the alternating layers having enhanced resistance to erosion from different angles of incidence which serve to keep an effective amount of the coating in place during an extended period of use.

In another aspect of the disclosure, an abradable coating can be applied to a substrate following a method wherein first and second abradable layers can be applied to the substrate, and the first and second abradable layers have different properties related to erosion resistance. The process can be repeated to apply as many first and second abradable layers as desired, and further can be modified to have multiple or thicker first or second layers, depending upon the angle of impact of expected erosion conditions to which the coated part is to be subjected.

Illustrative examples of multilayer coatings are provided below.

Example 1

First layer:
Nickel, chromium, aluminum
5-10% wt. hBN
<2% wt. additional elements
Cobalt as remainder
6% wt. organic binder (leads to porosity fraction of about 0.32)
Graded layer: ≤10 μm
Second layer:
7% Yttrium oxide
<3% additional elements (e.g. hafnium oxide)
Zirconium oxide as remainder.
Graded layer: ≤10 μm
Third layer: same as first layer
Graded layer: ≤10 μm
Fourth layer: same as second layer
Repeated layers may be added as needed.

In the above example, a bond coat layer with a thickness between 200 and 300 μm is desired and can be applied between the substrate and the first layer.

The first layer contains MCrAlY alloy and has porosity generated by burning off or otherwise removal of the organic binder such that the porosity fraction for this layer would be about 0.32. The second layer contains zirconium oxide and has substantially no porosity fraction, corresponding to a porosity fraction of about 0.02.

The 10 μm graded layer listed between first and second layers is a graded layer which transitions from the material of the first layer to the material of the second layer. In other words, at a mid-point of the graded layer, the composition would be approximately 50% material of the first layer and 50% material of the second layer.

The different combined features of these layers produces good erosion resistance for the first layer against erosion from particles impacting at a high angle of incidence, while the second layer has a good erosion resistance from particles impacting at a low angle of incidence. Further, the overall multilayer structure is abradable as desired, and this multilayer structure or coating can be applied at less cost than other known abradable coatings.

Example 2

In this example, a bond coat layer having a thickness between 200 and 300 μm is applied to the substrate. Then the following layers are applied over the bond coat.

First layer (no hBN):
Chromium, aluminum, tungsten, molybdenum, tantalum
<2% wt. additional elements
Nickel as the remainder
6% wt. organic binder (leads to a porosity fraction of about 0.37).
Second layer (with hBN):
Chromium, aluminum, tungsten, molybdenum, tantalum
<2% additional elements
Nickel as the remainder
5-10% wt. hBN.

Third layer: same as first layer

Fourth layer: same as second layer

Repeated layers may be added as needed.

In the above structure, the first and second layers are made from substantially the same material, with hBN being included only in the second layer, and with the first layer being provided with a porosity fraction of about 0.37. The second layer is substantially non-porous, having a porosity fraction of about 0.02. The added hBN enhances abradability of the multilayer structure, while the porosity fraction of the first layer provides this layer with greater resistance to erosion from particles impacting at a high angle of incidence, and the second layer provides greater resistance to erosion from particles impacting at a low angle of incidence.

There has been provided a multilayer abradable coating for turbines and compressors, which has a plurality of alternating different layers to provide different resistance to erosion depending upon the conditions of erosion to which the coating is exposed. While the disclosure has been made in the context of specific embodiments thereof, other unforeseen alternatives, modifications, and variations may become apparent to those skilled in the art having read the foregoing description. Accordingly, it is intended to embrace those alternatives, modifications, and variations that fall within the broad scope of the appended claims.

What is claimed is:

1. A multilayer abradable coating on a substrate, the coating comprising:

at least one first abradable layer; and at least one second abradable layer, wherein the first abradable layer and the second abradable layer have different properties related to erosion resistance, wherein the first abradable layer has a higher porosity fraction than the second abradable layer, and wherein the first abradable layer has higher erosion resistance than the second abradable layer against impacts at a high angle of incidence, and wherein the second abradable layer has higher erosion resistance than the first abradable layer against impacts at a low angle of incidence, wherein the first abradable layer has a porosity fraction of between about 0.15 and about 0.5, and wherein the second abradable layer has a porosity fraction of between about 0.02 and about 0.1.

2. The coating of claim 1, wherein the first abradable layer comprises a MCrAlY alloy where M is Ni, Co or NiCo, and wherein the second abradable layer comprises zirconia, magnesia, alumina or combinations thereof.

3. The coating of claim 2, wherein at least one of the first abradable layer and the second abradable layer further comprises a solid lubricant.

4. The coating of claim 3, wherein the solid lubricant is selected from the group consisting of graphene, graphite, graphite intercalation compounds, highly oriented pyrolytic graphite, molybdenum disulfide, clay, black phosphorous, hexagonal boron nitride, tungsten diselenide, rhenium disulfide, and combinations thereof.

5. An abradable coated part of a compressor, comprising:

a substrate; and a multilayer abradable coating on the substrate, the coating comprising at least one first abradable layer and at least one second abradable layer, wherein the first abradable layer and the second abradable layer have different properties related to erosion resistance, wherein the first abradable layer has a higher porosity fraction than the second abradable layer, and wherein the first abradable layer has higher erosion resistance than the second abradable layer against impacts at a high angle of incidence, and wherein the second abradable layer has higher erosion resistance than the first abradable layer against impacts at a low angle of incidence, wherein the first abradable layer has a porosity fraction of between about 0.15 and about 0.5, and wherein the second abradable layer has a porosity fraction of between about 0.02 and about 0.1.

6. The coated part of claim 5, wherein the first abradable layer comprises a MCrAlY alloy where M is Ni, Co or NiCo, and wherein the second abradable layer comprises zirconia, magnesia, alumina or combinations thereof.

7. The coated part of claim 6, wherein at least one of the first abradable layer and the second abradable layer further comprises a solid lubricant.

8. The coated part of claim 7, wherein the solid lubricant is selected from the group consisting of graphene, graphite, graphite intercalation compounds, highly oriented pyrolytic graphite, molybdenum disulfide, clay, black phosphorous, hexagonal boron nitride, tungsten diselenide, rhenium disulfide, and combinations thereof.

9. An abradable seal between two components of a compressor, comprising:

a coated part according to claim 5; and an abrasive part moveable relative to the coated part and configured to rub and abrade the coated part.

10. A method for applying an abradable coating to a substrate, comprising the steps of:

applying a first abradable layer to the substrate; and applying a second abradable layer over the first abradable layer, wherein the first abradable layer and the second abradable layer have different properties related to erosion resistance, wherein the first abradable layer has a higher porosity fraction than the second abradable layer, and wherein the first abradable layer has higher erosion resistance than the second abradable layer against impacts at a high angle of incidence, and wherein the second abradable layer has higher erosion resistance than the first abradable layer against impacts at a low angle of incidence, wherein the first abradable layer has a porosity fraction of between about 0.15 and about 0.5, and wherein the second abradable layer has a porosity fraction of between about 0.02 and about 0.1.

11. The method of claim 10, further comprising repeating the applying steps to produce a desired plurality of alternating first abradable layers and second abradable layers.

12. The method of claim 11, wherein the applying steps comprise thermal spraying, cold spraying and combinations thereof.

* * * * *